US007043767B2

(12) United States Patent
Jaeger

(10) Patent No.: US 7,043,767 B2
(45) Date of Patent: May 16, 2006

(54) VENTILATION SYSTEM FOR CLOTHING

(76) Inventor: Knut Jaeger, Stuttgarter Strasse 82, D-73230 Kircheim-Teck (DE)

( * ) Notice: Subject to any disclaimer, the term of this patent is extended or adjusted under 35 U.S.C. 154(b) by 137 days.

(21) Appl. No.: 10/176,461

(22) Filed: Jun. 20, 2002

(65) Prior Publication Data

US 2003/0033656 A1 Feb. 20, 2003

(30) Foreign Application Priority Data

Jun. 21, 2001 (DE) ..... 201 10 316 U
Jul. 12, 2001 (DE) ..... 201 11 640 U

(51) Int. Cl.
*A41D 27/28* (2006.01)

(52) U.S. Cl. ..... 2/87; 2/93; 2/DIG. 1

(58) Field of Classification Search ..... 2/2.15, 2/2.16, 69, 69.5, 85–89, 93, 94, 97, 115, 243.1, 2/102, 104, 4, 458, 159, 247, 209.5, 209.7, 2/227, 228, DIG. 1, 904
See application file for complete search history.

(56) References Cited

U.S. PATENT DOCUMENTS 385,306 A * 6/1888 Helwitz ..... 2/87
394,558 A * 12/1888 Crosby ..... 2/87
1,562,767 A * 11/1925 Hess ..... 2/87
2,259,560 A * 10/1941 Glidden ..... 428/134
2,771,661 A * 11/1956 Foster ..... 428/101
3,045,243 A * 7/1962 Seymour et al. ..... 2/1
3,296,626 A * 1/1967 Ludwikowski ..... 2/87
3,404,406 A * 10/1968 Balliet ..... 2/2.16
3,703,432 A * 11/1972 Koski ..... 428/132
3,783,451 A * 1/1974 Malin ..... 2/4
3,969,772 A * 7/1976 Pravaz ..... 2/79
4,004,294 A * 1/1977 Pinch ..... 2/104
4,270,227 A * 6/1981 Wolfe ..... 2/87
4,408,356 A * 10/1983 Abrams ..... 2/87
4,513,451 A * 4/1985 Brown ..... 2/69
4,569,874 A * 2/1986 Kuznetz ..... 428/109
4,576,087 A 3/1986 Wolfe
4,665,563 A * 5/1987 Harvey ..... 2/87
4,731,883 A * 3/1988 Foster ..... 2/69
4,807,303 A * 2/1989 Mann et al. ..... 2/69
4,985,933 A * 1/1991 Lemoine ..... 2/84
5,014,363 A * 5/1991 Hubner et al. ..... 2/243.1
5,105,477 A * 4/1992 Golde ..... 2/93
5,274,849 A * 1/1994 Grilliot et al. ..... 2/81
5,507,042 A * 4/1996 van der Slessen ..... 2/69
5,515,543 A * 5/1996 Gioello ..... 2/69
5,704,064 A * 1/1998 van der Sleesen ..... 2/69
5,727,256 A * 3/1998 Rudman ..... 2/115
5,845,336 A * 12/1998 Golde ..... 2/93
5,896,758 A * 4/1999 Rock et al. ..... 66/191
6,070,274 A * 6/2000 van der Sleesen ..... 2/456
6,112,328 A * 9/2000 Spector ..... 2/69
6,263,511 B1 * 7/2001 Moretti ..... 2/97

(Continued)

FOREIGN PATENT DOCUMENTS

DD 689904 8/1940

(Continued)

*Primary Examiner*—Alissa L. Hoey
(74) *Attorney, Agent, or Firm*—Dilworth & Barrese LLP.

(57) ABSTRACT

The invention relates to a ventilation system for clothing, in particular preferably watertight sports clothing, consisting of preferably watertight fabric, in which ventilation openings are provided which are covered by shingle-like overlaps of the fabric. In accordance with the invention, the air openings are closed by a flexible, three-dimensionally cross-linked spacer material.

16 Claims, 3 Drawing Sheets

U.S. PATENT DOCUMENTS

| | | | | |
|---|---|---|---|---|
| 6,427,242 | B1 * | 8/2002 | Bush et al. | 2/69 |
| 6,442,760 | B1 * | 9/2002 | Moretti | 2/115 |
| 6,585,582 | B1 * | 7/2003 | Ziegler | 454/78 |

FOREIGN PATENT DOCUMENTS

| | | | |
|---|---|---|---|
| DD | 822232 | | 11/1951 |
| DD | 3237713 | | 4/1983 |
| DD | 3820096 | | 12/1989 |
| DD | G901569.8 | | 1/1991 |
| DE | G9318838.2 | | 2/1994 |
| DE | 19547795 | | 6/1997 |
| EP | 0347634 | | 12/1989 |
| FR | 1166636 | | 11/1958 |
| GB | 2299059 | A * | 9/1996 |
| WO | 95/08276 | | 3/1995 |
| WO | 96/24263 | | 8/1996 |

* cited by examiner

VENTILATION SYSTEM FOR CLOTHING

BACKGROUND OF THE INVENTION

The invention relates to a ventilation system for clothing, in particular preferably waterproof, water tight and windproof sports clothing consisting preferably of watertight or windproof fabric, in which ventilation openings are provided which are covered by shingle-like overlaps of the fabric.

The term clothing is used very widely within the framework of the present invention. It relates to jackets, trousers, shirts, right down to headgear.

Waterproof clothing, in particular waterproof sports clothing, as a rule consists of a fabric which is coated such that it is waterproof and in individual cases, can even withstand a water pressure of up to 20,000 mm. High quality clothing with a special finish such as Goretex®, Sympatex®, Memotex®, etc. have the property that they are permeable to vapour and can lead up to 10,000 g of water vapour per $m^2$ to the outside, extreme clothing even more, within 24 hours. Despite this permeability to water vapour, these waterproof fabrics are absolutely air-tight. For this reason, jackets, coats or trousers processed from a corresponding material result in heat accumulation within a very short time when the user does sports. This in turn results in bodily overheating and to a fall in performance particularly unwanted when doing sports.

This problem has already been recognised and ventilation systems have therefore already been created for clothing which can in particular be opened by means of a zip or a hook and loop closure in particular when the outer environment is dry. In the event of moisture or rain, these vents must, however, be closed since otherwise moisture enters into the clothing from the outside through the air openings which are frequently disposed under the arms. Furthermore, the ventilation openings result in a cooling of the body when there is wind.

Solutions have also already become known in which shingle-like overlaps are formed by the fabric which cover the vent openings so that, for example, rainwater cannot penetrate from the outside and nevertheless water vapour (perspiration) can penetrate to the outside. However, this solution also still has the disadvantage that it is less Windproof, that moisture can penetrate through the vent slits under very heavy rain and that the ventilation of the shingle-like overlap does not work, e.g. when the material surfaces lie on top of one another or stick together when wet.

It is therefore the object of the invention to provide a ventilation system for clothing, wherein neither moisture nor wind can penetrate from the outside, but hot or moist air can penetrate from the body to the outside and an absolutely dosable, controlled ventilation can take place which is only slightly impaired even when rucksacks are worn.

SUMMARY OF THE INVENTION

In accordance with the invention, this object is solved by the combination of the features of the ventilation system air openings being closed by a flexible, three-dimensionally cross-linked spacer material. Accordingly, the ventilation system for clothing preferably consists of waterproof or windproof fabric in which air openings are provided which are covered, on the one hand, by shingle-like overlapping of the fabric, with the air openings, however, being closed by a flexible, three dimensionally cross-linked spacer material. This solution in accordance with the invention results in a considerably improved climatisation of the body and thus to a maintaining of performance or an increase in the performance of the user doing sports. This improved climatisation is carried out in that moist, hot air can escape through the ventilation system in an unlimited manner within a very short time due to body movement and due to the natural pressure drop between the body heat inside and the as a rule cooler air outside. Whereas the emission of larger amounts of water vapour requires several hours with a "breathable fabric" of the prior art, with the solution in accordance with the invention, the discharge of the water vapour takes place within seconds. With so-called "breathable" fabrics, which are in practice, however, air tight, such as were also used in the prior art, an emission of body heat and/or of water vapour is as a rule only possible with limitations. It is the capability to control the amount of the air exchange a) by the thickness of the mesh b) by the level of the overlap which is important.

Preferred aspects of the invention result from the subordinate claims dependent on the main claim.

The spacer material can preferably consist of a three-dimensional spacer fabric, a three-dimensional and air-permeable mesh material made of plastic, which is already used for the ventilation of rucksacks, automobile seats and the like. This material consists of a water repellent plastic material which has a comparatively thin fabric layer and a thicker mesh structure layer, with both layers being combined with one another to form a unit.

Alternatively, the flexible, three-dimensionally cross-linked spacer material can consist of a foam layer or a plastic fibre fleece such as is used as a deep filter.

An advantage of the spacer material in accordance with the invention is the simple processing capability. It can be simply sewn, riveted or otherwise connected to the respective material layer.

The flexible, three-dimensionally cross-linked spacer material can have a pore diameter varying with the layer thickness. A coarse pore diameter can be provided at the outer surface and a fine pore diameter at the inner surface. In this connection, the finest pore diameter is advantageously selected such that the whole three-dimensionally cross-linked spacer material is mosquito-tight.

In accordance with a particularly advantageous aspect, the shingle-like overlapping can be sewn at its outer edge to a first outer edge of the strip-like spacer material, whereas the second outer edge of the strip-like spacer material is sewn to the outer edge of the fabric layer covered by the shingle-like overlapping. In this way, the spacer material is covered at one side by the lower fabric layer and on the opposite side by the shingle-like overlapping fabric layer. The air permeability is ensured by means of this sewing technique. On the other hand, water and wind cannot penetrate. The spacer material is advantageously worked with the watertight material such that the remaining seams on the inside of the clothing can be taped over in a watertight manner with an adhesive tape. Alternatively, the corresponding seams can also be welded. Since the watertight, three-dimensionally cross-linked spacer material is attached to the inside of the clothing and is covered by means of the shingle-like overlapping, rainwater cannot even penetrate into the jacket with a very strong wind or storm. On the other hand, the ventilation works without limitations, however, due to the spacer material.

In an alternative embodiment, the strip-like spacer material is inserted into a slit-like ventilation opening in the fabric layer covered by the shingle-like overlapping. In this case, the strip-like spacer material is therefore processed without a watertight rear wall. This solution is also largely watertight due to the use of the water repellent, three-dimensionally cross-linked spacer material.

The strip-shaped spacer materials in accordance with the above embodiments can also be arranged next to one another in addition to the formation of two and more ventilation openings. In this way, relief-like strips result on, the piece, of clothing which act as design elements despite their technical dependence. In this connection, the arrangement of the corresponding ventilation slots can be of any kind.

An alternative embodiment results in that the flexible, three-dimensionally cross-linked spacer material is integrated into the clothing surface as an areal, for example strip-like, element; and in that it can be flipped open or put together in a flip-like manner due to the overlaps covered in a shingle-like manner so that the spacer material lies freely on the clothing surface. In this case, the spacer materials are used in large areas, for example with shirts or jackets on the chest or back, on the side areas or under the arms. They act as design elements and offer a good ventilation with mosquito protection. This sports clothing is advantageously suitable in the sector of summer sports clothing, running clothing, e.g. for power walking and power hiking, or it can be used as well-ventilated travel clothing in tropical countries.

BRIEF DESCRIPTION OF THE DRAWINGS

Further details and advantages of the invention are described in more detail with reference to embodiments shown in the drawing.

There are shown.

DESCRIPTION OF THE PREFERRED EMBODIMENTS

Figure 1:
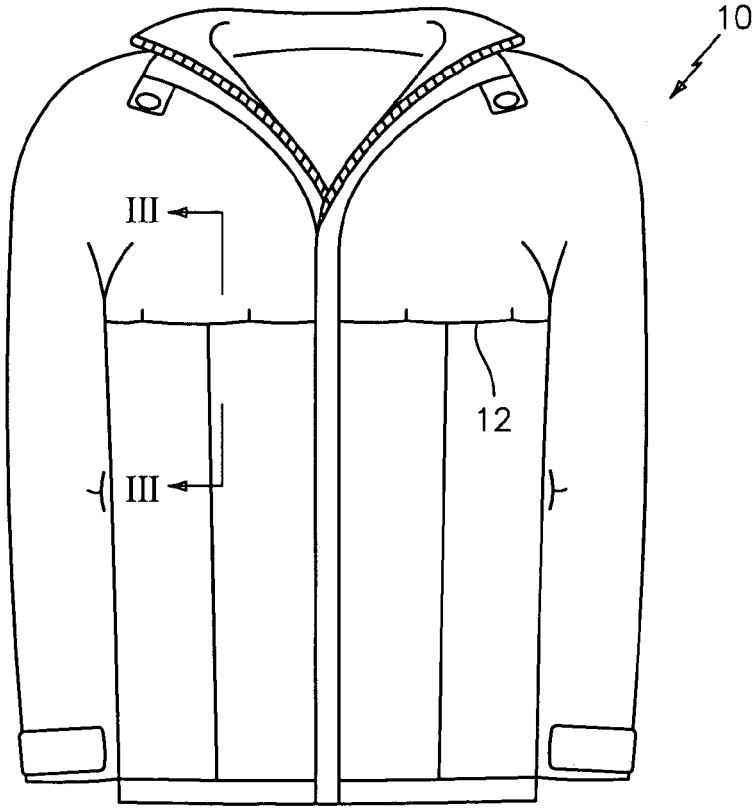
FIG. 1: a jacket as an exemplary embodiment of a piece of clothing with the ventilation system in accordance with the invention.

The ventilation system in accordance with the invention can be usable with any pieces of clothing. For instance, jackets, coats or also trousers and headgear can be thought of here. Ventilations in jackets are as a rule attached to the chest or to the back or under the arms, whereas with trousers they are practically attached in the region of the back pockets. In FIG. 1, a sports jacket 10 is shown in which the ventilation system 12 is arranged in slit-like manner in the chest region. The design of the ventilation system present here results from FIGS. 3 and 4. In the sectional representation in accordance with FIG. 3, a shingle-like overlap 14 made of a watertight fabric such as Goretex® is initially shown which covers a lower fabric layer 16 of the same material in the form of a shingle-like overlap 18. The fabric layer 14 is connected along its seamed outer edge 20 by means of a seam 22 to an outer edge 24 of a strip-like spacer material 26 up to and into the region forming the shingle-like overlap 18. The opposite side edge 28 of the strip-shaped spacer material 26 is connected by means of a seam 32 to the covered outer edge 30 of the lower fabric layer 16. The ventilation slot formed by the shingle-like overlap is thus completely filled up by means of the strip-shaped spacer material. The air here penetrates substantially in the longitudinal direction through the spacer material. Due to its water repellent property, the penetration of rainwater is reliably prevented, whereas the water vapour caused by perspiration can penetrate from the inside to the outside. Air convection from the outside is also possible without wind here being able to penetrate inside through the opening which would result in strong air convection and thus to strong cooling.

Figure 3:
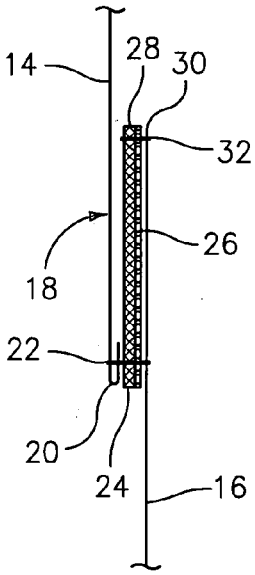
FIG. 3: a section along the section line III—III in FIG. 1.
Figure 4:
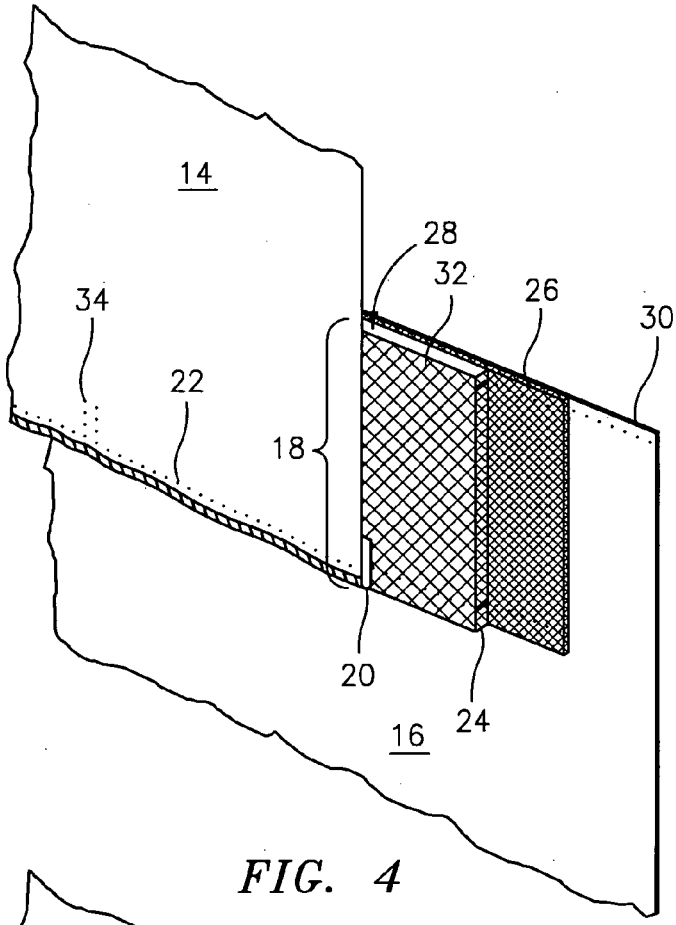
FIG. 4 a perspectively partly sectioned representation of a part of the ventilation system in accordance with the invention in accordance with FIG. 3.

As can in particular be seen from FIGS. 3 and 4, the design of the ventilation system has been selected such that the penetration of moisture by capillary rising of this moisture in the three-dimensional mesh is also reliably prevented. The selection of the watertight fabric as the inner material contributes to the solution of this problem.

To prevent a back-flip of the shingle-like overlap 18, the fabric layer 14 forming the shingle-like overlapping is connected at points by means of locking seams 34 along its outer edge 20 forming the overlapping at a plurality of points 34 with the fabric layer 16 disposed thereunder and the strip-shaped spacer material 26 lying therebetween.

In a manner not shown in more detail in the Figure, the seams are taped over with watertight adhesive tape or welded from the inside.

Figure 2:
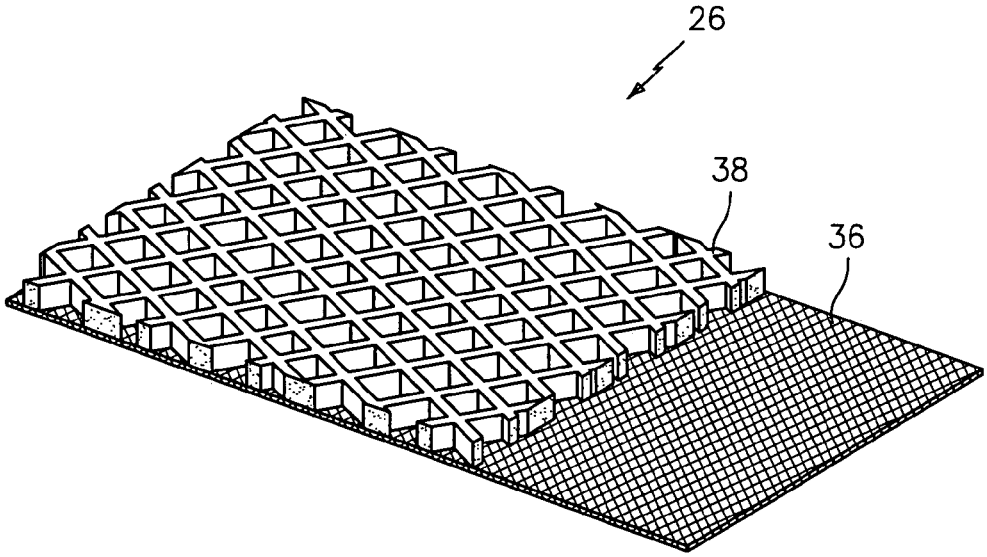
FIG. 2: a three-dimensionally, partly sectioned representation of the spacer fabric used in accordance with the invention.

The design of the spacer material 26 such as is used in the embodiment results from FIG. 2. Here, a spacer fabric is represented which is designed with two layers. On the one band, one side is formed by a comparatively thin fabric layer 36 made of water repellent plastic material. A thicker mesh structural layer 38 is connected to this fabric layer 36 to form a unit.

Figure 5:
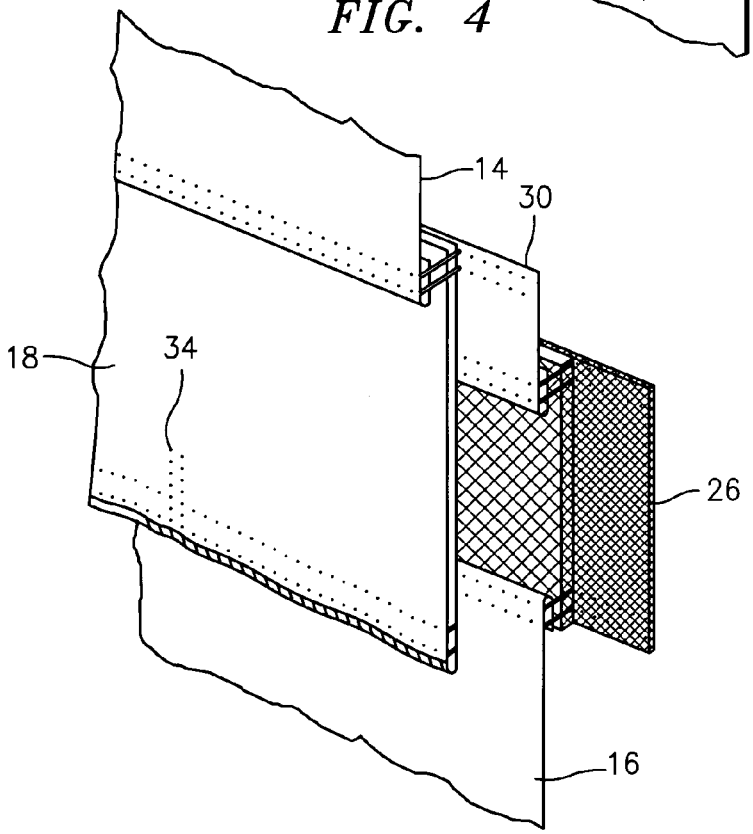
FIG. 5: a perspective representation similar to that in accordance with FIG. 4, but showing an alternative embodiment in accordance with the invention.

In FIG. 5, an alternative aspect of the ventilation system for clothing is shown. Here, a longitudinally extending slot is arranged in the lower fabric layer 16 and the strip-like spacer material 26 is sewn into this in the manner shown in detail here. The upper outer edge 30 of the fabric layer 16 is sewn to the outer edge of the outer fabric layer 14, with the one outer edge of the shingle-like overlapping 18 made as a separate layer being additionally sewn in this seam. Otherwise, the shingle-like overlapping 18 is sewn at points at its outer edge at several points to the fabric layer 16 disposed thereunder via the locking seams 34.

This alternative embodiment shown in FIG. 5 can be used in less demanding pieces of clothing. Here, the overlapping is in any case also made such that no water can penetrate either.

Figure 6:
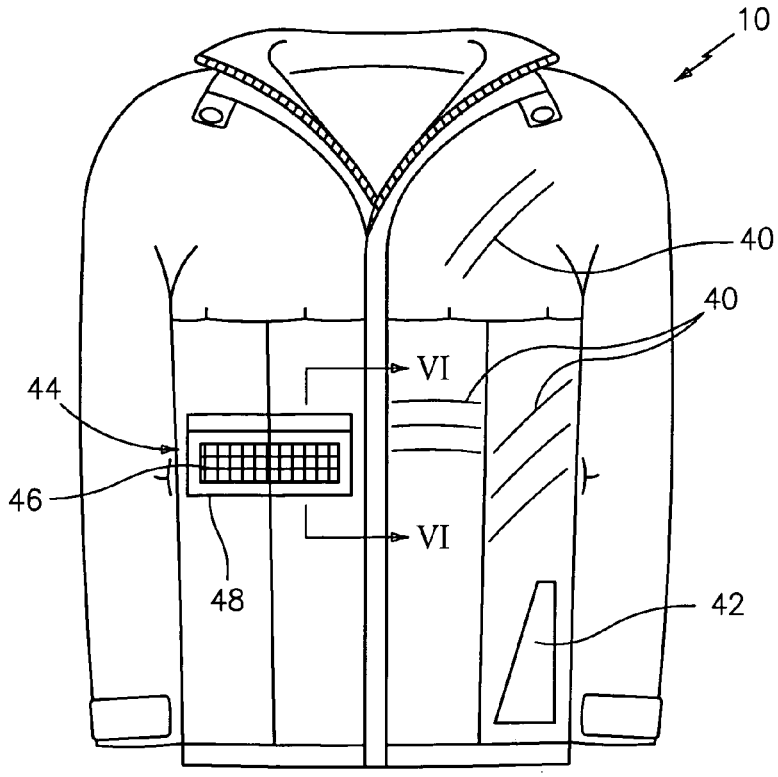
FIG. 6: a jacket modified with respect to the representation in FIG. 1 as a further exemplary embodiment of a piece of clothing with the ventilation system in accordance with the invention, with here respectively different ventilation systems being shown on the right hand side and on the left hand side of the jacket.

In FIG. 6, further different alternative embodiments of the ventilation system in accordance with the invention are shown. For instance, a variation width of ventilation systems is shown here in a sports jacket 10 which include a plurality of slit-like ventilations systems 40 arranged next to one another, with these being able to be arranged as multiple ventilations, for example, under the arms, in the chest region or in the shoulder region. A perpendicular version is shown at 42, with here the spacer material being shaped in approximately a wedge-shape manner, such as shown as part 42. This wedge-like design can, however, be seen only as an opening slot on the outside of the jacket 42 counter to the presentation made here, whereas the remaining material is covered by the clothing material.

Figure 7A:
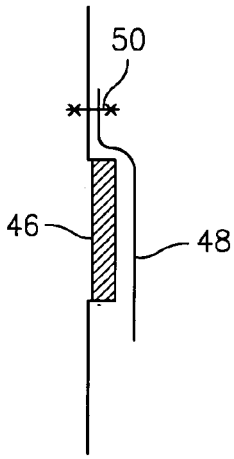
FIG. 7: a section along the line VI—VI (FIG. 7*a*) and this embodiment with an exposed spacer material (FIG. 7*b*)
Figure 7B:
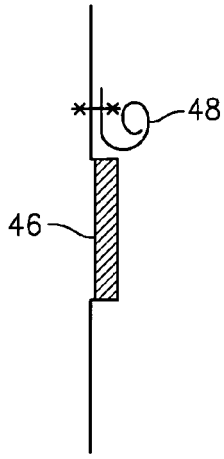
Figure 8:
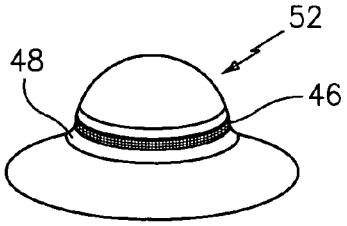
FIG. 8: a hat as an alternative exemplary embodiment of a piece of clothing with the ventilation system in accordance with the invention.

At the left hand side of the sports jacket 10 shown in FIG. 6, an alternative ventilation system 44 is shown. Here, the flexible, three-dimensionally cross-linked spacer material is integrated into the clothing surface as an areal, for example a strip-like, element 46. This means that the element 46 is sewn at each case at the edges to the remaining clothing material, as can be seen from the sketch in FIG. 7. A flap 48 is arranged above this areal element 46 and can cover the areal element 46 as is shown in FIGS. 6 and 7*a*. The flap 48 is sewn to the jacket via a corresponding seam 50, for example at one side. The flap 48 consisting of the clothing fabric can, as shown in FIG. 7, be flipped up or rolled together so that the areal element 46 is exposed. In this way, in particular when used for summer clothing, running clothing or travel clothing, a good ventilation is made possible. For protection against rain, moisture and wind, the flap 48 can be correspondingly laid over the areal element 46 again. The flap 48 can be positioned in the respective locations by hook and loop bands or bands which can be knotted to one another. A closure by zip would also be conceivable. These connection possibilities are not shown here. Whereas the preceding Figures are always shown with reference to the example of a sports jacket 10, in FIGS. 8 and 9 variations of pieces of clothing are indicated in which the ventilation systems of the invention can be used. For instance, a hat 52 is shown in FIG. 8 which includes an areal element 46 consisting of a flexible, three-dimensionally cross-linked spacer material. This element 46 can be covered, as shown for example in FIG. 7, by means of the flap 48. Here, therefore, a hat ventilation is, for example, possible by exposing the areal element 46. On the other hand, mosquito protection is provided due to the comparatively fine-pore spacer material.

Figure 9:
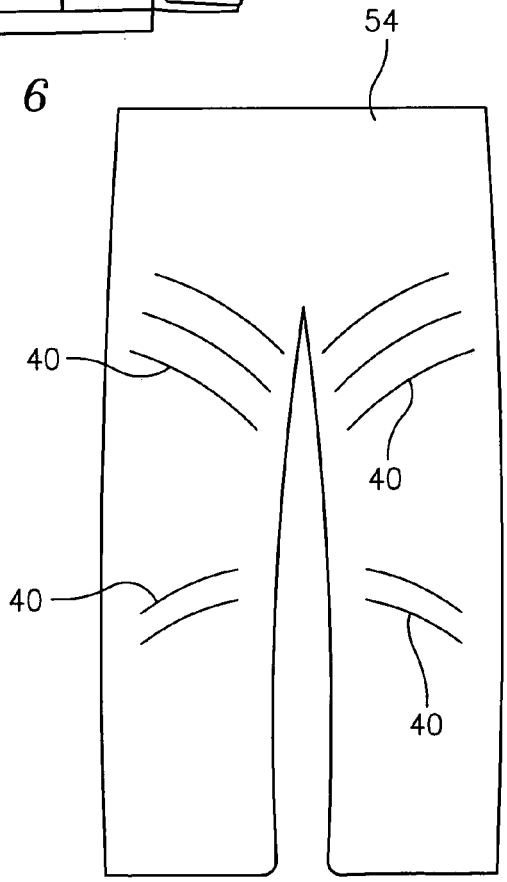
FIG. 9: a pair of trousers as an exemplary embodiment of a piece of clothing with the ventilation system in accordance with the invention.

In FIG. 9, a pair of sports trousers 54 is shown as the piece of clothing in which different arrangements of the slit-like vents 40 have been integrated by way of example.

The invention claimed is:

1. A ventilation system for clothing, preferably watertight and windproof sports clothing, composed preferably of watertight or windproof fabric, said ventilation system comprising ventilation openings, shingle-like overlaps of the fabric structured and arranged to cover the ventilation openings, and a flexible, three-dimensionally intertwined or cross-linked spacer material structured and arranged to close the ventilation openings, wherein said spacer material is in the form of a strip having first and second outer edges, with a first outer edge of said spacer material being sewn to an outer edge of said shingle-like overlap, and a second outer edge of said spacer material being sewn to an outer edge of a fabric layer covered by said shingle-like overlap, and said first lower edge of said spacer material is sewn to said lower outer edge of said shingle-like overlap and said second upper edge of said spacer material is sewn to said upper outer edge of said covered fabric.

2. The system of claim 1, wherein the spacer material is constituted by mesh.

3. The system of claim 2, wherein said spacer material comprises two layers, a layer of said mesh and a layer of fabric connected to said mesh layer.

4. The system of claim 1, wherein said spacer material is composed of fabric.

5. The system of claim 1, wherein said spacer material comprises a foam layer.

6. The system of claim 5, wherein said spacer material additionally comprises plastic fiber fleece.

7. The system of claim 1, wherein said spacer material is composed of a plastic fiber fleece.

8. The system of claim 1, wherein said spacer material has a pore diameter varying with layer thickness.

9. The system of claim 1, wherein said spacer material has a coarse pore diameter at an outer surface thereof and a fine pore diameter at an inner surface thereof.

10. The system of claim 1 wherein said spacer material comprises two layers, a layer of mesh and a layer of fabric connected to said mesh layer, with said shingle-like overlap, mesh layer, connected fabric layer and covered fabric layer arranged in that order from outside to inside the clothing.

11. The system of claim 1, additionally comprising a fabric layer covered by said shingle-like overlap, with said shingle-like overlap being sewn at points along an outer edge thereof to said covered fabric layer disposed thereunder by locking seams.

12. The system of claim 11, wherein said seams are taped over with watertight adhesive tape or welded from inside.

13. The system of claim 1, wherein fabric covered by said shingle-like overlap is composed material permeable to water vapor.

14. The system of claim 1, wherein two or more ventilation openings are arranged next to one another.

15. The system of claim 1, wherein said spacer material is in the form of a strip.

16. The system of claim 1, wherein said ventilation openings are provided through fabric of the clothing, said spacer material is positionable over said openings and upon said fabric, and said shingle-like overlap is separately positionable to cover said openings and overlap said fabric.

* * * * *